United States Patent [19]

Harry et al.

[11] 4,245,861

[45] Jan. 20, 1981

[54] CORE GRIPPER

[76] Inventors: Edward G. Harry, P.O. Box 13A, Gresham, Wis. 54128; Stephen L. Hirschboeck, 1402 Oshkosh St., New London, Wis. 54961

[21] Appl. No.: 61,591

[22] Filed: Jul. 30, 1979

[51] Int. Cl.[3] ..... B66C 1/54

[52] U.S. Cl. ..... 294/94; 294/67 A

[58] Field of Search ..... 294/67 A, 67 AA, 67 AB, 294/86 LS, 86.24, 86.25, 93, 94, 96, 103 CG; 269/48.1; 242/72 R; 279/2 R; 414/910, 911

[56] References Cited

U.S. PATENT DOCUMENTS

| | | | |
|---|---|---|---|
| 2,561,745 | 7/1951 | Lerch | 242/72 |
| 3,006,565 | 10/1961 | Pelletier | 242/72 X |
| 3,007,652 | 11/1961 | Heckman | 242/72 |
| 3,792,868 | 2/1974 | Flagg | 279/2 R |

FOREIGN PATENT DOCUMENTS

| | | | |
|---|---|---|---|
| 262608 | 7/1949 | Switzerland | 279/2 R |
| 128191 | 7/1919 | United Kingdom | 279/2 R |

*Primary Examiner*—Johnny D. Cherry

*Attorney, Agent, or Firm*—Russell L. Johnson

[57] ABSTRACT

A device for gripping the insides of cores of rolls of materials, and comprising a polygonal central cam, multiple gripping cylinders which are held against the cam by resilient retainer rings and a cylindrical sleeve which retains the gripping cylinders in longitudinal slots passing through the sleeve. The gripping cylinders are caused to move radially inward and outward when the sleeve is rotated relative to the cam and the cylinders are urged outward by the corners of the cam or inward by the resilient retainer rings as the cylinders move from the corners of the polygon to the sides of the polygon.

5 Claims, 5 Drawing Figures

FIG. 1
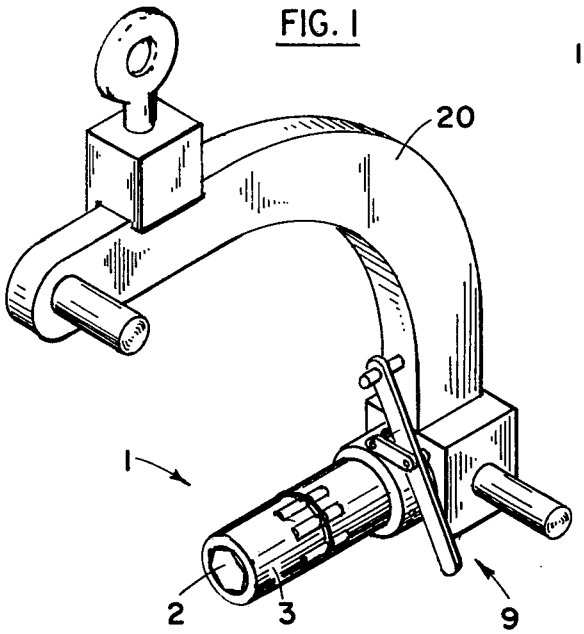
FIG. 3
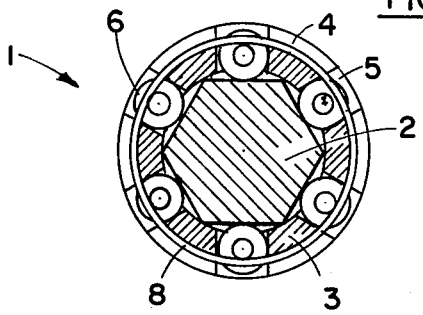
FIG. 4
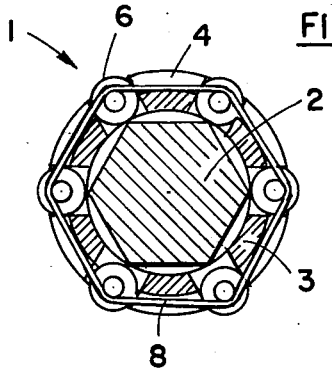
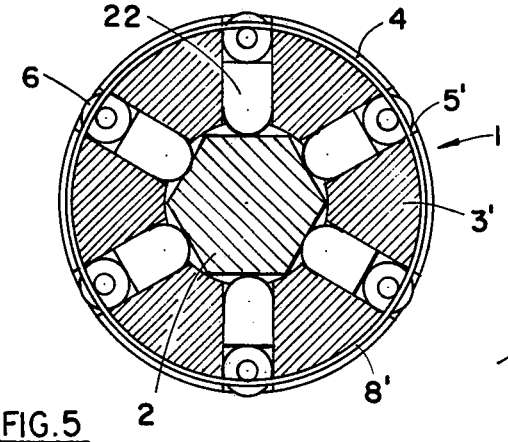
FIG. 5
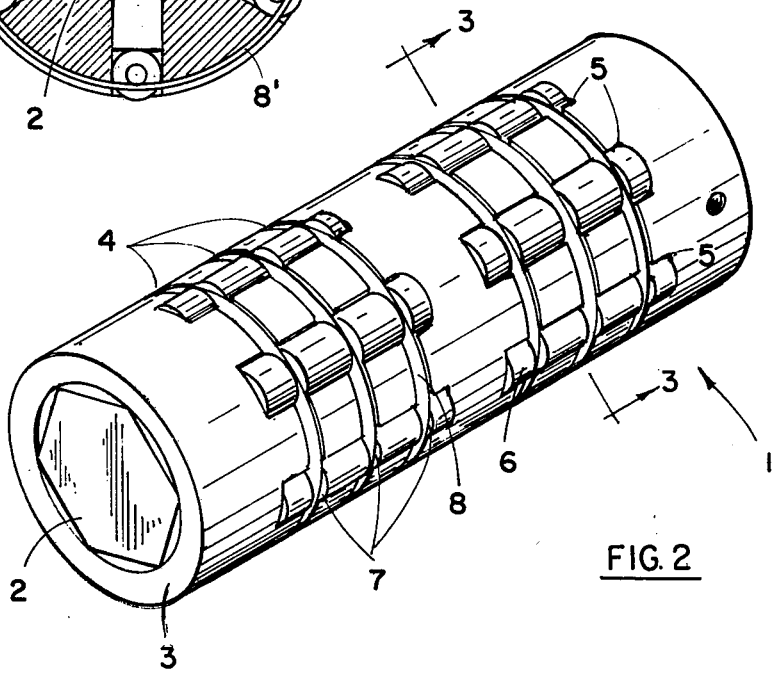
FIG. 2

CORE GRIPPER

BACKGROUND OF THE INVENTION

Roll handling equipment which is intended to grip the cores of rolls of material for the purpose of transporting the rolls has the advantage of not contacting the sides or ends of the rolls and therefore being less apt to damage the material wound upon the rolls. The strength and dependability of the core gripper dictates the size and weight of rolls that can be handled by the gripper. The mechanical strength of the core gripper is therefore the principle factor which limits the capacity of a core gripper.

In use, the core gripper is inserted into the core of a roll of material. The core gripper is then expanded inside the core so as to mechanically imbed into the core material and/or frictionally engage the core material. Rolls are frequently stored and lifted with the axis of the core vertical and therefore the strength of the engagement between the core gripper and the inside of the core is all that is carrying the weight of the roll at that time. When the roll is being held so that its axis is in the horizontal position, the core gripper is functioning in part as a cantilevered beam.

The problem faced by those wishing to increase the capacity and improve the performance of core grippers of this type is; one of providing the mechanical strength required for the several gripping and transporting requirements of the core gripper and doing it inside the small diameter permitted by the inside of roll cores.

BRIEF DISCUSSION OF THE PRIOR ART

Prior art core gripping mechanisms which are employed in much the same way as the device of this invention are generally complex in structure and do not afford the strength of grip of the instant invention. U.S. Pat. No. 2,759,757 to Pace teaches a complex mechanical arrangement for expanding gripping elements to contact the inside of pipe. The mechanism is of utility for the handling of relatively large pipe but of little utility in handling small diameters due to the need for providing linkage inside the gripper.

U.S. Pat. No. 2,826,445 to Tidland; U.S. Pat. No. 2,507,577 to Reynolds; and U.S. Pat. No. 2,882,086 to Steinbach all teach expanding mandrel type core grippers. This type of gripper has an outer gripping surface that nearly conforms to the contours of the inner surface of the core to be gripped. This geometry does not permit the imbeding of the gripper into the core surface in the manner of the small diameter grooved cylinders of the instant invention. The mechanical as well as the frictional engagements of the gripping cylinders of the instant invention has greater holding strength than the grips obtainable by these prior art devices.

The prior art does not show or teach the use of a polygonal cam to engage cylindrical grippers carried by a sleeve to grip the inside of a roll core. The inventor believes his invention to be novel in its mechanics and its simple and rugged construction.

BRIEF DESCRIPTION OF THE INVENTION

This invention in its simplest form comprises five elements;

(1) a polygonal control cam (2) a multiplicity of gripping cylinders which bear against the cam, (3) a multiplicity of resilient members which maintain the cylinders against the cam, (4) a cylindrical sleeve which surrounds the cam and has longitudinal slots passing through its walls in which the cylinders rest, and (5) a means for rotating the sleeve relative to the cam.

In the preferred embodiment the central cam has a regular hexagonal cross section and the cam is fixed in relation to the core of the roll to be gripped. The cross section of the cam may be that of any regular polygon from a minimum of three sides to a one of 10 or more sides. The central cam may also be rotatable in embodiments wherein it is preferred to have the sleeve fixed relative to the core when in use.

In the preferred embodiment twelve gripping cylinders are used. They are arranged in two rings of six gripping cylinders each. The cylinders have circumferential grooves machined therein. The sleeve has similarly spaced circumferential grooves machined in its outside surface. The gripping cylinders fit into longitudinal slots which pass through the wall of the sleeve at the location of the grooves. The slots are evenly spaced around the circumference of the sleeve (60° apart in the preferred embodiment). Any suitable number of rings of slots and grippers may be used, but in the preferred embodiment two rings of grippers are used.

The assembly of the core gripper is achieved by passing the sleeve over the cam and attaching it to a sleeve rotating means. The gripping cylinders are then placed in the slots in the sleeve. Resilient O-rings are then placed in the grooves in the sleeves and the mating grooves in the gripping cylinders. The O-rings thereby retain the gripping cylinders in the slots and against the polygonal cam.

In use the sleeve is rotated until the gripping cylinders rest upon the sides of the polygonal cam. The core gripper mechanism is then inserted into the core of the roll to be handled. The sleeve rotating mechanism is then rotated so that the gripping cylinders are urged towards the corners of the polygonal cam and thereby urged outward and into engagement with the inside of the core. The sleeve is then locked in place and the roll is handled by conventional means such as hoists and the like. When it is desired to release the grip on the core the sleeve is rotated in the opposite direction which carries the gripping cylinders towards the sides of the polygonal cam and the grip on the core is thereby released.

BRIEF DESCRIPTION OF THE DRAWINGS

FIG. 1 is a pictorial view of the core gripper of this invention attached to a conventional G-frame roll handling means.

FIG. 2 is an enlarged view of the core gripper of FIG. 1.

FIG. 3 is a cross sectional view of the gripper of FIG. 2 with the grippers retracted.

FIG. 4 is a cross sectional view of the gripper of FIG. 2 with the grippers expanded.

FIG. 5 is a cross sectional view similar to that of FIGS. 3 and 4 showing an adaptor for gripping large cores.

DETAILED DESCRIPTION OF THE INVENTION

In the drawings like numerals refer to like elements of the invention.

Referring now to FIGS. 1 through 5. Core gripper 1 comprises a polygonal fixed central cam 2; an external sleeve 3 having circumferential grooves 4 and longitudinal slots 5 passing through sleeve 3 and crossing grooves 4; gripping cylinders 6 having circumferential grooves 7 spaced so as to align with grooves 4 of sleeve 3; elastic retaining rings 8 which seat in grooves 7 and 4 and retain cylinders 6 in slots 5 and against cam 2; and rotating means 9 which serves to rotate sleeve 3 relative to cam 2.

In FIG. 1 core gripper 1 is shown attached to a G-frame roll handling hoist 20 of conventional design. In use rotating means 9 would rotate sleeve 3 until cylinders 6 were in the retracted position shown in FIG. 3. Core gripper 1 would then be inserted into the core of the roll to be handled. Rotating means 9 would then rotate sleeve 3 into the position shown in FIG. 4. The rotation of sleeve 3 relative to fixed cam 2 carries cylinders 6 towards the vertices of the polygonal cam and thereby urges cylinders 6 outward into frictional and/or mechanical engagement with the inside of the core of the roll to be handled. To release the grip on the core, sleeve rotating means 9 is used to rotate sleeve 3 in the opposite direction and resilient rings 8 move cylinders 6 out of engagement with the core and into the position shown in FIG. 3. Core gripper 1 is then removed from the core and the use cycle is complete.

Referring now to FIG. 5. The novel construction of the core gripper of this invention permits easy and rapid changing of the outer sleeve of the gripper thus permitting the use of adapter sleeve 3' for larger diameter cores. Sleeve 3' has bars 22 residing in slots 5' which serve to transmit the action of cam 2 to grippers 6. Resilient ring 8' is similar to ring 8 in construction and function.

While many variations of this invention may be employed to great utility without leaving the scope of the invention; there are two variations the inventor wishes to specifically place within the scope of his invention. The first is; that of employing a fixed sleeve and a rotatable cam arrangement to practice the invention. The second is; the use of regular polygons other than hexagons as cams. The polygonal cam may have a cross section which is a regular polygon of 3 or more sides. Polygons of larger numbered sides are of utility in core grippers of large diameter.

While the preferred embodiment has been disclosed herein it should be understood that the scope of the invention is limited only by the appended claims and all equivalents thereto which would become readily apparent to one skilled in the art.

What is claimed is:

1. A core gripper for roll lifting, transporting, are handling equipment comprising;

(1) an elongate central cam having a regular polygonal cross section, (2) a cylindrical sleeve which is co-axial with the cam and which surrounds the cam and the sleeve has at least one ring of regularly spaced longitudinal slots passing through the walls of the sleeve and the number of slots equals the number of sides of the polygonal cam and the sleeve is provided with at least one circumferential groove passing around the sleeve at the location of the slots, (3) a multiplicity of gripping cylinders equal in number to the number of slots in the sleeve and the cylinders are slightly smaller in diameter than the width of the slots and the cylinders have at least one circumferential groove therein and the number of grooves in the cylinders is at least equal to the number of grooves in the sleeve and the grooves in the cylinders are alignable with the grooves in the sleeve, (4) a resilient retainer ring which seats in the grooves in the sleeve and in the mating grooves in the cylinders and thereby retains the cylinders in the slots in the sleeve and resiliently maintains the cylinders in contact with the cam, (5) a means for providing relative rotational movement between the cam and the sleeve around their common longitudinal axis and the sleeve and cam, and a mechanical means for providing relative rotational movement between the cam and the sleeve are operably mounted to an apparatus for handling, lifting and transporting rolls.

2. The gripper of claim 1 wherein the number of rings of slots is greater than one and the number of circumferential grooves in the sleeve at each ring of slots is greater than one and the cross section of the cam is that of a regular hexagon.

3. The gripper of claim 1 wherein the cam is fixed and the sleeve is rotatable relative to the cam.

4. The gripper of claim 1 wherein the sleeve is fixed and the cam is rotatable relative to the sleeve.

5. The gripper of claim 1 wherein the sleeve is readily exchangeable with a second sleeve of a different diameter and the wall thickness of the second sleeve is greater than the diameter of the cylinders and the slots have residing therein linkage bars by means of which the relative movement of the cam is transmitted to the gripping cylinders.

* * * * *

UNITED STATES PATENT AND TRADEMARK OFFICE

CERTIFICATE OF CORRECTION

PATENT NO. : 4,245,861

DATED : January 20, 1981

INVENTOR(S) : Edward G. Harry et al.

It is certified that error appears in the above—identified patent and that said Letters Patent is hereby corrected as shown below:

Column 4, line 2, "are" should read -- and --.

Signed and Sealed this

Ninth Day of June 1981

[SEAL]

Attest:

RENE D. TEGTMEYER

Attesting Officer

Acting Commissioner of Patents and Trademarks